United States Patent [19]

Tuomala

[11] 4,283,169

[45] Aug. 11, 1981

[54] HAND OPERABLE EMERGENCY SIGNALING DEVICE

[76] Inventor: Leon A. Tuomala, 1585 E. Cipres Ct., Camarillo, Calif. 93010

[21] Appl. No.: 40,327

[22] Filed: May 18, 1979

[51] Int. Cl.[3] ..... F21K 5/02

[52] U.S. Cl. ..... 431/359; 116/DIG. 44; 362/11

[58] Field of Search ..... 340/321, 331; 362/11, 362/13, 15, 8; 431/361, 362, 359; 116/202, 213, 279, 280, 7, DIG. 44, 105, 5

[56] References Cited

U.S. PATENT DOCUMENTS

| | | | |
|---|---|---|---|
| 3,947,221 | 3/1976 | Mauser | 431/361 |
| 4,060,372 | 11/1977 | Beck et al. | 362/11 |
| 4,116,615 | 9/1978 | Hall et al. | 431/539 |
| 4,146,356 | 3/1979 | Marecek et al. | 431/361 |
| 4,147,497 | 4/1979 | Haraden | 361/11 |

*Primary Examiner*—James J. Groody
*Attorney, Agent, or Firm*—Jack C. Munro

[57] ABSTRACT

A distress and emergency signaling device which takes the form of a base member attached to a conventional photographic flash cube. The flash cube is of the type that does not require any electrical energy from an outside source. A base is attached to the flash cube. Within each base are a plurality of manually movable members with there being a separate member for each flash bulb of the flash cube. Operation of a movable member causes release and movement of a wire to strike a metallic rod connected to a particular flash bulb of the flash cube which causes flashing of the bulb.

2 Claims, 4 Drawing Figures

Fig. 1
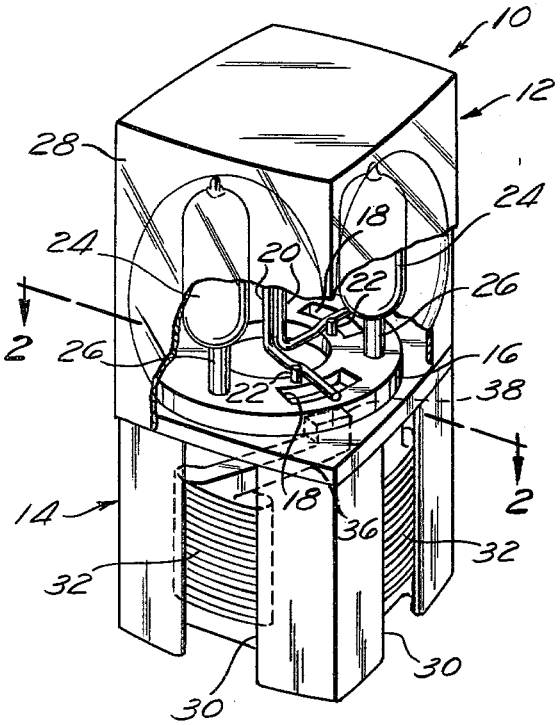
Fig. 2
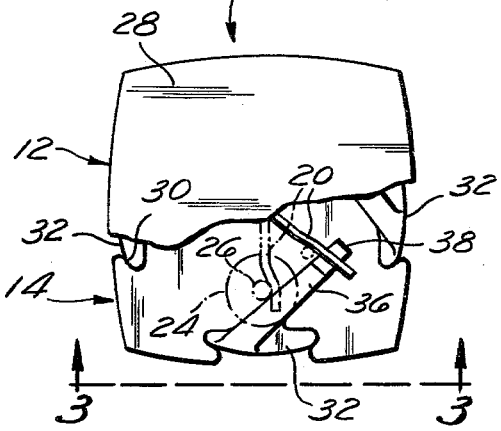
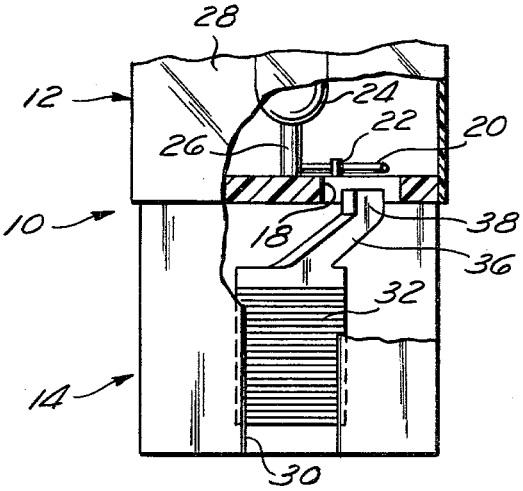
Fig. 3
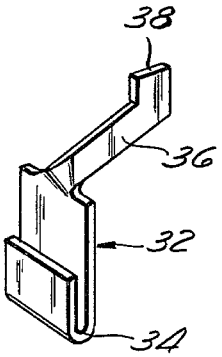
Fig. 4

HAND OPERABLE EMERGENCY SIGNALING DEVICE

BACKGROUND OF THE INVENTION

The field of this invention relates to distress and emergency signaling devices and more particularly to a disposable signaling device which employes the use of the conventionally available photographic flash cubes which are capable of emitting a short, bright light.

People who hike or otherwise venture into remote, unpopulated areas such as woods, deserts and the like, usually find it wise to carry on their person some type of emergency signaling device. Not only is there the possibility of that person becoming lost, but also the person may become injured requiring the assistance of medical personnel.

It has been common in the past to employ some type of device to attract attention. A common form of a device would be a flare gun which shoots a burning projectile into the air. Another type of device would be a brightly colored balloon which is released into the air and tethered to or adjacent to the person.

The use of such emergency or distress devices is most desirable since the discovering of an individual in a remote area is frequently not easy even though an observer may be within a helicopter or small plane. In the past, it has been almost impossible to locate a person in distress during the night time.

There is a definite need for an emergency signaling device which is readily portable, light in weight, inexpensive to purchase and which is usable not only in the day time but also at night time and is easy to operate by people of all ages.

SUMMARY OF THE INVENTION

The structure of this invention is believed to be summarily described in the Abstract of the Disclosure and reference is to be had thereto.

A primary objective of this invention is to construct an easily operated distress and emergency signaling device which can be readily carried by the young and the old, is inexpensive to purchase, has a plurality of uses, and when once used can be readily disposed of with a new device to then be employed.

BRIEF DESCRIPTION OF THE DRAWING

FIG. 1 is partial, cut-away, isometric view of the signaling device of this invention;

FIG. 2 is a partial, cut-away, view taken along line 2—2 of FIG. 1 depicting the operation of an individual flash bulb;

FIG. 3 is a side view, partially cut-away, taken along line 3—3 of FIG. 2; and

FIG. 4 is an isometric view of the movable member which is to be manually moved within the base of the signaling device in order to effect operation of a single flash bulb.

DETAILED DESCRIPTION OF THE SHOWN EMBODIMENT

Referring particularly to the drawing, there is shown the signaling device 10 of this invention which is composed primarily of a flash cube 12 and a base 14. The flash cube 12 is deemed to be conventional and is to be described as generally including a mounting base 16 which has a plurality (four in number) of spaced-apart openings 18. Extending across each opening 18 is a separate wire member 20. It is to be understood that there are four in number of separate wire members 20. Each wire member 20 is held in position across its respective opening 18 by means of a pin 22. Each member 20 is mounted within the flash cube 12 so that each member 20 is biased or cocked so that if a member 20 is disconnected from its pin 22, that the member 20 will move across plate 16.

Also mounted within appropriate openings formed within the plate 16 are a plurality (four in number) of flash bulbs 24. Each flash bulb 24 is connected to a metal rod 26 which functions as the supporting base. The metal rod 26 is mounted within an opening formed within the base 16. Each metal rod 26 is located a short distance spaced from its respective cocked wire member 20.

Located within each flash bulb 24 is a quantity of flashable material such as an ignitable stranded mass of metallic fibers. These metallic fibers are connected to the wire rod 26. A coating is formed on the wire rod 26 and if this coating is struck, this coating will produce a small amount of electrical current. This electrical current is sufficient to ignite the stranded metallic fibers and cause burning within the bulb 24. This produces a bright flash which is well known in the field of photography.

It can therefore be seen that upon a wire member 20 being removed from its respective pin 22, the wire member 20 will then move against the wire rod 26 for a particular flash bulb 24. This in turn causes a flash bulb 24 to fire. This firing of the flash bulb 24 is for the purpose of attracting attention.

It is to be noted that the operator will have at his disposal four separate flash firings for each signal device 10. Once all four flash bulbs 24 have been fired, the operator is then to discard the signaling device 10 and employ a new signaling device 10. It is to be understood from the drawing that the flash bulbs 24 are protected by means of a transparent cover 28.

In order to effect operation in each of the individual flash bulbs 24, the base 14 includes four in number of elongated grooves 30. Within each groove is slidably mounted an actuating member 32. The actuation member 32 is formed of a strip of material which is bent over on itself at the bottom end thereof forming a U-shaped member 34. The upper end of the member 32 includes a transverse extension 36 which is integrally secured to an activating protuberance 38. Because of the U-shaped section 34, there is a slight amount of give which causes the member 32 to be biased slightly outwardly into snug contact with the walls of its respective groove 30. This permits the member 32 to be manually moved but yet prevents free sliding movement of the member 32. It is desirable that accidental movement of the member 32 be prevented and that only purposeful movement of the member 32 be permitted.

Upon manual engagement by a person's finger with a member 32 and that member moved in the direction toward the flash cube 12, the actuating protuberance 38 comes into contact with the wire member 20. When the member 32 is moved sufficiently, the wire member 20 is disassociated from the pin 22 which then causes the member 20 to move and strike the wire rod 26 thereby activating the flash bulb 24. The bulb 24 that is activated is located on the same side as the member 32. It is to be understood that there are four separate members 32 for each flash bulb 24. It is also to be understood that upon the flashing of the bulb 24 that the device 10 has operated in the desired manner.

In order to further prevent accidental operation of the flash bulb 24, each groove 30 is recessed within the base 14 which also means that each member 32 is also slightly recessed within the base 14. Therefore, the operator has to reach within the recess area of the groove 30 in order to engage the member 32, which tends to prevent accidental operation.

Further, it is to be noted that the U-shaped section 34 of each member 32 is located spaced a short distance from the bottom of the base 14. This not protruding of the members 32 exteriorly of the bottom surface of the base 14 also prevents accidental movement of the members 32.

What is claimed is:

1. A distress and emergency signaling device comprising:

a flash cube constructed of a plurality of flash bulbs, each said flash bulb being separately activatable by activation means, said flash cube being polygonal shaped forming four in number of sides, there being a separate flash cube for each said side, said activation means for each said bulb comprising a cocked member under a continuous spring bias; and a base fixedly attached to said flash cube, said base having a cross-sectional size substantially equal to the cross-sectional size of said flash cube, said base including manually operable actuation means, said actuation means comprises a separate actuation member for each said flash bulb with there being four in number of said actuation members, each said actuation member to connect with a separate said cocked member, each said actuation member being slidably mounted for lineal movement within a groove formed within a said base with there being a separate said groove for each said actuation member, said lineal movement for each said actuation member being directly in line with its respective said flash bulb, each said groove being sufficiently recessed so each said actuation member is totally recessed within said base to prevent accidental operation of said actuation members, upon manual operation of a said actuation member the said cocked member for the respective said flash bulb is activated which causes flashing of the said flash bulb.

2. The signaling device as defined in claim 1 wherein:

each said actuation member being biased into snug contact with the walls of its respective said groove, whereby undesired sliding movement of said members is prevented.

* * * * *